US006470505B1

(12) United States Patent
Boisvert

(10) Patent No.: US 6,470,505 B1
(45) Date of Patent: Oct. 29, 2002

(54) WATER EFFICIENT TOILET

(75) Inventor: Paul Boisvert, Laval (CA)

(73) Assignee: Perfecteau LLP, Sudbury, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/510,389

(22) Filed: Feb. 22, 2000

(30) Foreign Application Priority Data

Feb. 22, 1999 (CA) ..... 2263609
Mar. 15, 1999 (CA) ..... 2264989

(51) Int. Cl.[7] ..... E03D 1/08
(52) U.S. Cl. ..... 4/354; 4/322; 4/425; 4/435
(58) Field of Search ..... 4/354, 362, 332, 4/425, 434, 435, 420; 138/30

(56) References Cited

U.S. PATENT DOCUMENTS

| | | | | |
|---|---|---|---|---|
| 705,319 A | * | 7/1902 | Bush | 4/420 |
| 1,821,300 A | | 9/1931 | Gavin | |
| 2,282,636 A | | 5/1942 | Bennett | |
| 4,115,883 A | | 9/1978 | Dauvergne | |
| 4,310,934 A | * | 1/1982 | Hennessy et al. | 4/354 X |
| 5,204,999 A | * | 4/1993 | Makita et al. | 4/425 X |

FOREIGN PATENT DOCUMENTS

| | | | | |
|---|---|---|---|---|
| DE | 2700781 | | 7/1978 | |
| GB | 2054041 | * | 2/1981 | 138/30 X |
| JP | 02161027 | | 6/1990 | |
| WO | WO 94/08103 | | 4/1994 | |

* cited by examiner

*Primary Examiner*—David J. Walczak
*Assistant Examiner*—Kathleen J. Prunner
(74) *Attorney, Agent, or Firm*—Michael R. Hanna

(57) ABSTRACT

A water efficient toilet includes a self pressurized tank connected to a water supply through conduits and includes a valve operatively connected to the conduits. The toilet assembly has a bowl with inner walls, the bowl having a lower reservoir connected to a trap way and an upper rim with a channel therein. The channel is provided with a plurality of openings and the lower reservoir of the bowl has through holes. The through holes of the lower reservoir and the channel of the upper rim of the bowl are connected to the valve by a first and second conduit. When flushing the toilet by opening the valve, a phased inflow of water in the toilet is induced. The phased inflow of water includes an initial and an intermediate inflow of water. The initial inflow of water passes into the first conduit and through the through holes of the lower reservoir to initiate the evacuation of the contents of the lower reservoir through the trap way into a drain pipe. Subsequently, the intermediate inflow of water passes into the second conduit and into the channel of the upper rim. The intermediate inflow of water washes the inner walls of the bowl and completes, in conjunction with the initial inflow of water, the evacuation of the contents of the lower reservoir. When the valve is closed, a final inflow of water is induced by releasing, via gravity, a predetermined volume of water into the lower reservoir.

26 Claims, 2 Drawing Sheets

WATER EFFICIENT TOILET

FIELD OF THE INVENTION

The present invention relates to a water efficient toilet. More specifically, the present invention relates to an improved water efficient toilet that minimizes the volume of water required during the flushing operation, while improving the performance compared to typical toilets.

BACKGROUND OF THE INVENTION

The typical toilet, usually referred to as "gravity tank-type toilet", relies on the principle of gravity to drain the water contained in the tank or reservoir into the toilet bowl, thus raising the level of water in the bowl. Once the water level is raised to its designed level, a siphon effect will pull the water and contents into the drain. This flushing process uses a considerable volume of water to achieve its goal, and to date, the most basic way to reduce water usage when using such "gravity tank-type toilets" is by storing a reduced volume of water in the reservoir.

Permissible maximum flush rates vary by jurisdiction and are measured in gallons per flush (gpf) or liters per flush (1 pf). Consequently, the lowest known flush rates demanded in the USA are currently 1.6 gpf or 6 lpf, reduced from 3.5 gpf or 13.2 1 pf. This reduction has been achieved by reducing the water volume stored in the reservoir (tank), at the expense of introducing significant performance issues, often requiring multiple flushing.

An alternative solution has been to propose pressurized water toilets. Such a toilet has at least a pressurized water supply, valve means and a flush valve actuator. These known pressurized water toilet flushing systems have improved the performance of toilets at the 1.6 gpf or 6 pf flush rate.

Nevertheless, such prior art pressurized water toilets exhibit operating characteristics that can be improved and they are still using a significant volume of water to effectively flush the toilet.

There is thus a need for a water efficient toilet that is more economical in terms of water volume used during the flushing operation because of the concern caused by decreasing water supplies and the consequent need for water conservation measures.

SUMMARY OF THE INVENTION

The present invention relates to a water efficient toilet which includes a self pressurized tank connected to a water supply through conduit means. The water efficient toilet also includes a toilet assembly and valve means operatively connected to the conduit means. The toilet assembly has a bowl with inner walls. The bowl has a lower reservoir connected to a trap way and an upper rim with a channel therein. The channel is provided with a plurality of openings and the lower reservoir of the bowl has at least one through hole. The at least one through hole of the lower reservoir and the channel of the upper rim of the bowl are connected to the valve means by a first and a second conduit, respectively. When flushing the toilet, the valve means is opened, and a phased inflow of water in the toilet is induced. The phased inflow of water includes an initial and an intermediate inflow of water. The initial inflow of water passes into the first conduit and through the at least one through hole of the lower reservoir to initiate the evacuation of the contents of the lower reservoir through the trap way into a drain pipe. Subsequently, the intermediate inflow of water passes into the second conduit and into the channel fo the upper rim. The intermediate inflow of water washes the inner walls of the bowl and completes, in conjunction with the initial inflow of water, the evacuation of the contents of the lower reservoir. When the valve means is closed, a final inflow of water is induced by releasing, via gravity, a predetermined volume of water into the lower reservoir. This volume of water is contained in the channel of the upper rim, and in the first and the second conduit.

According to a preferred embodiment, the conduit means includes a first and a second segment and each segment of the conduit means has a diameter. The first segment is disposed upstream of the self pressurized tank and the second segment is disposed downstream of the self pressurized tank. The diameter of the first segment of the conduit is preferably smaller than the diameter of the second segment of the conduit means.

According to another preferred embodiment, the channel of the upper rim, and the first and second conduit have a combined volume of water that is preferably equivalent to the predetermined volume of water of the lower reservoir.

According to a further preferred embodiment, the at least one through hole and the first conduit have each a diameter. The diameter of the at least one through hole is preferably smaller than the diameter of the first conduit.

BRIEF DESCRIPTION OF THE DRAWINGS

The present invention and its advantages will be more easily understood after reading the following non-restrictive description of a preferred embodiment thereof, made with reference to the following drawings wherein.

DESCRIPTION OF A PREFERRED EMBODIMENT

Figure 1:
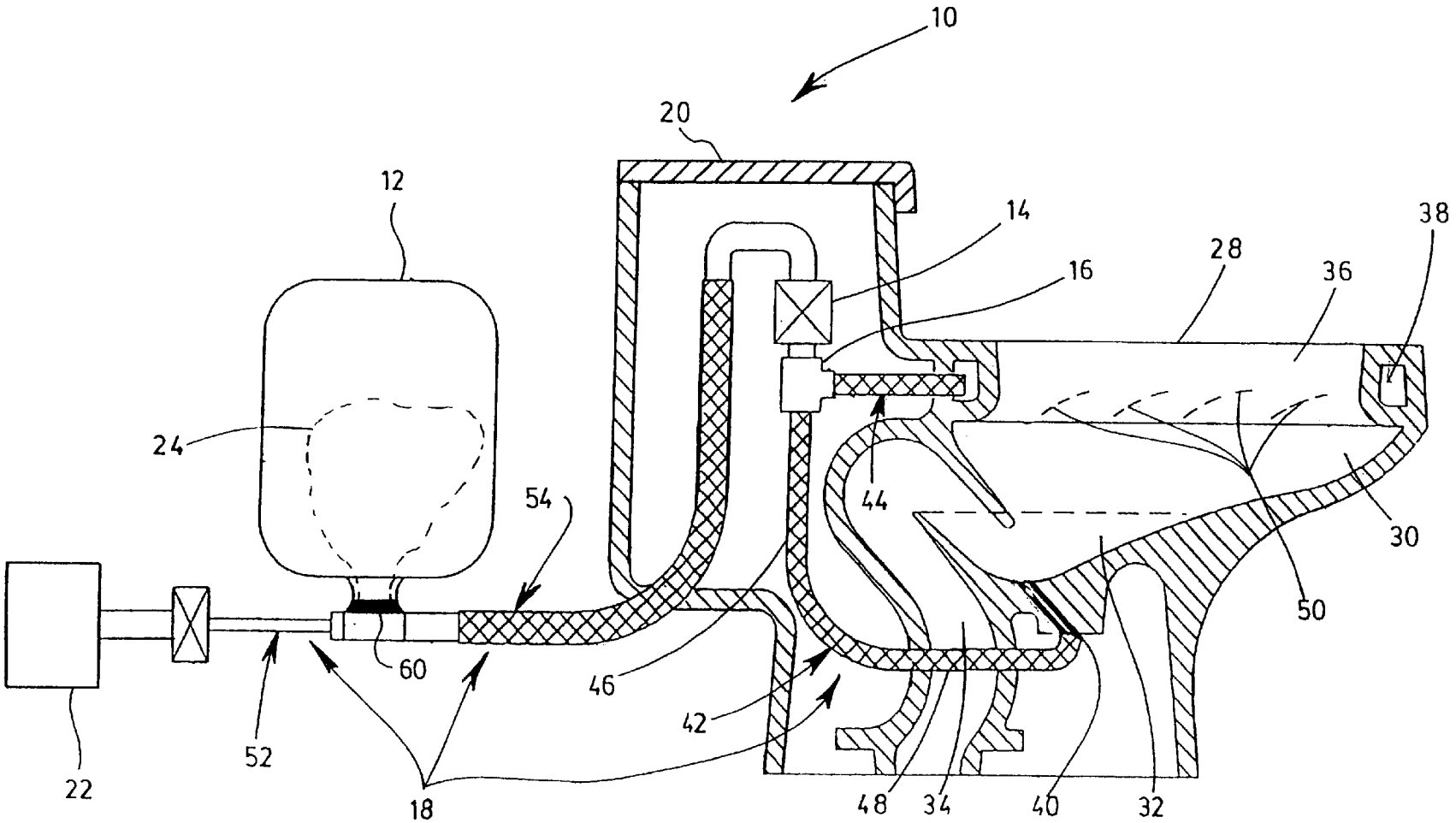
FIG. 1 is a cross-sectional view of a water efficient toilet according to a preferred embodiment of the invention.
Figure 2:
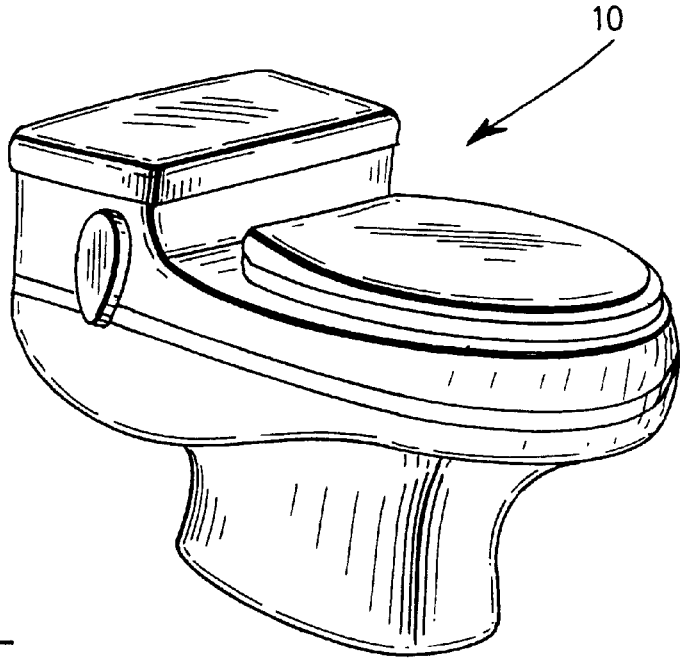
FIG. 2 is a perspective view of a water efficient toilet mounted on a floor.
Figure 3:
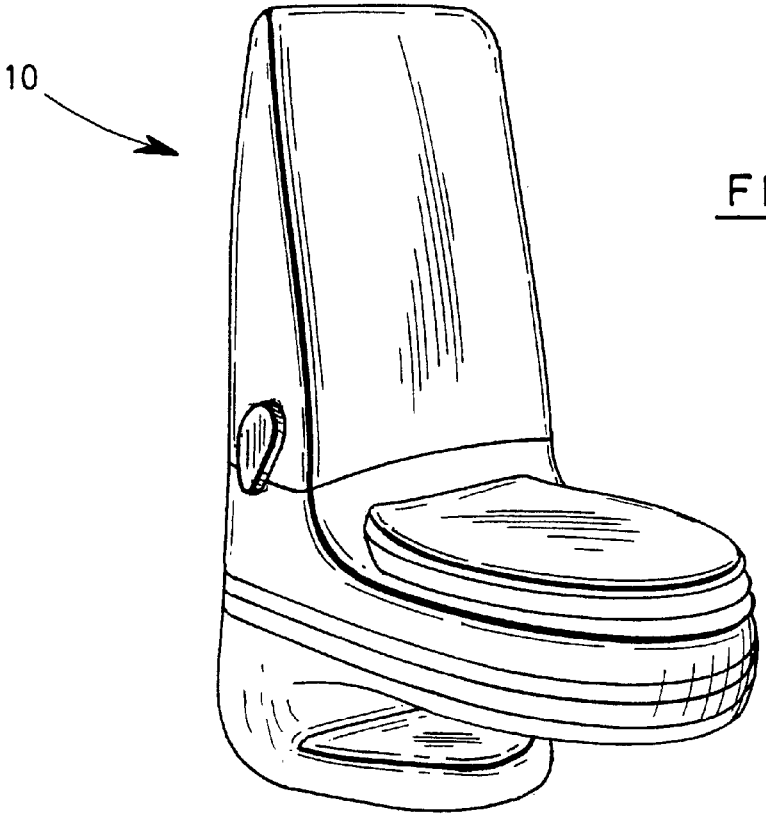
FIG. 3 is a perspective view of a water efficient toilet mounted on a wall.

The efficient toilet (10) further includes valve means (14) and connection means (16) which are operatively connected to conduit means (18), and a specifically designed toilet assembly (20). The connection means (16) is disposed downstream of the valve means (14), the latter being preferably a ball or cylindrical valve. Advantageously, the ball valve is a standard, off-the-shelf ball valve that is modified by removing the upper cushion of the ball valve and by simply gluing the bottom cushion to its original position. This modification improves the waterproofness of the ball valve. However, it should be understood that any valve will meet the objects of the invention, provided it remains open, whether automatically or manually operated, for a predetermined amount of time, corresponding generally to the time it takes for the necessary volume of water to pass through the valve means (14).

The self pressurized tank (12) is connected, preferably in parallel, to a water supply (22) through conduit means (18). The self pressurized tank (12), in a preferred embodiment of the invention, comprises a flexible membrane (24), preferably in the form of a bladder, attached to a connection fitting (60) at the bottom of the tank (12).

The conduit means (18) includes a first (52) and a second (54) segment and each segment (52, 54) of the conduit means (18) has a diameter. The diameter of the first (52)

segment of the conduit means (18) is preferably smaller than the diameter of the second segment (54) of the conduit means (18). The first segment (52) is disposed upstream of the self pressurized tank (12) whereas the second segment (54) is disposed downstream of the self pressurized tank (12). Indeed, residential plumbing systems typically provide ¼" connections for toilets. These connections do not provide a sufficient volume of water in a short enough time to adequately flush the toilet without pressurized water storage means. Consequently, the present invention makes use of a storage tank and larger diameter pipes (¾") to provide the toilet with a large volume of water in a short period of time. Accordingly, it is preferred that the diameter of the pipes be larger downstream of the tank. However, it should be understood that in commercial installations, or in installations where larger pipes or high pressure is present, the self-pressurized tank can be omitted altogether, and that it is not essential that there be a difference in diameters of the conduit means upstream and downstream of the self-pressurized tank, if the latter is present.

The toilet assembly (20) has a bowl (28) with inner walls (30). The bowl (28) further has a lower reservoir (32) connected to a trap way (34) and an upper rim (36) with a channel (38) therein. The channel (38) is provided with a plurality of openings (50) and the. lower reservoir (32) of the bowl (28) has at least one through hole (40) , but advantageously two. It has been found that two through holes is the optimal number of through holes according to the design criteria and dimensions of the conduits in view of meeting the objects of the present invention. However, alternative configurations will fulfill the goal of the invention.

The at least one through hole (40) of the lower reservoir (32) and the channel (38) of the upper rim (36) of the bowl (28) are connected to the valve means (14) by a first (42) and a second (44) conduit, respectively.

The first conduit (42) has a first section (46) disposed vertically and a second section (48) disposed horizontally. The second conduit (44) is substantially disposed horizontally.

The lower reservoir (32) is advantageously designed to contain the predetermined volume of water and it is preferably calibrated to hold approximately the same amount of water as contained in the channel(38) of the upper rim (36), the first and second conduit (42,44) and the connection means (16). It will be understood that the above mentioned same amount of water is defined in its volume by the design criteria and dimensions of the channel (38) of the upper rim (36), the first and second conduit (42,44) and the connection means (16), all designed to refill the lower reservoir (32) while minimizing leakage into a drain pipe (not shown), thus eliminating the potential of wasting water.

When a user flushes the toilet (10) of the present invention by actuating the valve means (14) in an open position, a phased inflow of water into the toilet (10) is induced. More specifically, once the valve means (14) are opened, water inflow from the ¼" connection is initiated and the water contained in the self-pressurized tank (12) is pushed out by the pressurized air in the tank (12), thereby providing the conduit means (18) with a large volume of water in a very short period of time.

The phased inflow of water includes an initial and intermediate inflow of water. The initial inflow of water passes into the first conduit (42) and through the at least one through hole (40). of the lower reservoir (32) to initiate the evacuation of the contents of the lower reservoir (32) through the trap way (34) into the drain pipe. When the water reaches the at least one through hole (40), which preferably have a diameter smaller than the diameter of the first conduit, a pressure build-up is initiated within the first conduit (42) As the pressure builds up in the first conduit (42), water will start to flow into the second conduit (44) and into the channel (38) of the upper rim (36). Therefore, the intermediate inflow of water flows into the bowl (28) through the openings (50) of the channel (38) to wash the inner walls (30) of the bowl (28) and to complete, in conjunction with the continuing initial flow of water through the at least one through hole (40) of the lower reservoir (32), the evacuation of the contents of the lower reservoir (32) through the trap way (34) into the drain pipe. The openings (50) of the channel (38) are preferably parallel to each other and are preferably disposed at a 45 degree angle with respect to the upper rim (36) of the bowl (28) so as to provide a circular flow of water within the bowl (28).

Immediately after the closing of the valve means (14), a final inflow of water is induced. A small amount of water will leak through the openings (50) of the channel (38) to complete washing the inner walls of the bowl. The rest of the water remaining in the channel (38) of the upper rim (36), the first (42) and the second conduit (44), and the connection means (16) will drain via gravity, through the at least one through hole (40), into the lower reservoir (32) thus refilling the lower reservoir (32), re-establishing the water seal and completing the flush cycle. Meanwhile, after the closing of the valve means, water which is still supplied by the water supply refills the self-pressurized tank until an equilibrium, in terms of pressure, is obtained.

Within approximately five seconds, the water efficient toilet (10) of the present invention is ready again for use. It is worth mentioning that the water efficient toilet according to the preferred embodiment of the invention described herein completes its flush cycle in approximately 3 seconds and uses approximately 2 liters of water per flush. Variations of the components of the toilet within the scope of the appended claims will result in a toilet using significantly less than 6 1pf, but not in all cases 2 1pf.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A water efficient toilet including:

a self pressurized tank being connected to a water supply through conduit means, said water supply supplying said toilet with water through said conduit means;

valve means operatively connected to said conduit means;

a toilet assembly having a bowl with inner walls, said bowl having a lower reservoir connected to a trap way and an upper rim having a channel therein, said channel being provided with a plurality of openings, said lower reservoir of the bowl having at least one through hole, said at least one through hole of the lower reservoir and said channel of the upper rim of the bowl being connected to the valve means by a first and a second conduit, respectively, wherein said toilet is flushed by actuating said valve means between:

an open position of said valve means so as to induce a phased inflow of water in said toilet, said phased inflow of water including an initial and an intermediate inflow of water, said initial inflow of water passing into the first conduit and through said at least one through hole of the lower reservoir to initiate evacuation of the contents of the lower reservoir through the trap way into a drain pipe, and, subsequently, said intermediate inflow of water passes into the second conduit and into the channel of the upper rim, said intermediate inflow of water washing the inner walls of the bowl and completing, in conjunction with the initial inflow of water, the evacuation of the contents of the lower reservoir, and a closed position of said valve means so as to induce a final inflow of water by releasing, via gravity, a predetermined volume of water into the lower reservoir, said predetermined volume of water being contained in the channel of the upper rim, and in the first and the second conduits;

and wherein said self pressurized tank has enough capacity to provide a large volume of water in a short period of time so as to assist the flush.

2. A water efficient toilet according to claim 1, wherein the conduit means includes a first and a second segment, each segment of the conduit means having a diameter, the first segment being disposed upstream of the self pressurized tank, and the second segment being disposed downstream of the self pressurized tank, the diameter of said first segment of the conduit means being smaller than the diameter of said second segment of the conduit means.

3. A water efficient toilet according to claim 2, wherein the channel of the upper rim, and the first and second conduits have a combined volume of water that is substantially equivalent to the predetermined volume of water of the lower reservoir.

4. A water efficient toilet according to claim 3, wherein the self pressurized tank is connected in parallel to the conduit means.

5. A water efficient toilet according to claim 4, wherein the self pressurized tank comprises a flexible membrane being attached to a connection fitting on the self pressurized tank.

6. A water efficient toilet according to claim 5, wherein the self pressurized tank is of cylindrical shape.

7. A water efficient toilet according to claim 6, wherein the valve means is a ball or a cylindrical valve.

8. A water efficient toilet according to claim 7, wherein the at least one through hole and the first conduit have each a diameter, the diameter of the at least one through hole being smaller than the diameter of the first conduit.

9. A water efficient toilet according to claim 8, wherein the openings of the channel are parallel to each other and are disposed at a 45 degree angle with respect to the upper rim of the bowl so as to provide a circular flow of water within the bowl.

10. A water efficient toilet including:

a self pressurized tank being connected to a water supply through conduit means, said water supply supplying said toilet with water through said conduit means;

valve means and connection means operatively connected to said conduit means, said connection means being disposed downstream of said valve means;

a toilet assembly having a bowl with inner walls, said bowl having a lower reservoir connected to a trap way and an upper rim having a channel therein, said channel being provided with a plurality of openings, said lower reservoir of the bowl having at least one through hole, said at least one through hole of the lower reservoir and said channel of the upper rim of the bowl being connected to the connection means by a first and a second conduit, respectively, said first conduit having a first section disposed vertically and a second section disposed horizontally, said second conduit being substantially disposed horizontally, wherein said toilet is flushed by actuating said valve means between:

an open position of said valve means so as to induce a phased inflow of water into said toilet, said phased inflow of water including an initial and an intermediate inflow of water, said initial inflow of water passing into the first conduit and through said at least one through hole of the lower reservoir to initiate the evacuation of the contents of the lower reservoir through the trap way and into a drain pipe, and subsequently, a pressure build-up is initiated within the first conduit when water traveling in the first conduit reaches the at least one through hole, said pressure build-up traveling back in the first conduit until it reaches the connection means, thereby initiating said intermediate inflow of water, said intermediate inflow of water passing into the second conduit and into the channel of the upper rim, said intermediate inflow of water washing the inner walls of the bowl and completing, in conjunction with the initial inflow of water, the evacuation of the contents of the lower reservoir, and a closed position of said valve means so as to induce a final inflow of water by releasing, via gravity, a predetermined volume of water into the lower reservoir, said predetermined volume of water being contained in the channel of the upper rim, the connection means and the first and the second conduits;

and wherein said self pressurized tank has enough capacity to provide a large volume of water in a short period of time so as to assist the flush.

11. A water efficient toilet according to claim 10, wherein the conduit means includes a first and a second segment, each segment of the conduit means having a diameter, the first segment being disposed upstream of the self pressurized tank, and the second segment being disposed downstream of the self pressurized tank, the diameter of said first segment of the conduit means being smaller than the diameter of said second segment of the conduit means.

12. A water efficient toilet according to claim 11, wherein the channel of the upper rim, the first and second conduits and the connection means have a combined volume of water that is substantially equivalent to the predetermined volume of water of the lower reservoir.

13. A water efficient toilet according to claim 12, wherein the self pressurized tank is connected in parallel to the conduit means.

14. A water efficient toilet according to claim 13, wherein the self pressurized tank comprises a flexible membrane being attached to a connection fitting on the self pressurized tank.

15. A water efficient toilet according to claim 14, wherein the self pressurized tank is of cylindrical shape.

16. A water efficient toilet according to claim 15, wherein the valve means is a ball or a cylindrical valve.

17. A water efficient toilet according to claim 16, wherein the at least one through hole and the first conduit have each a diameter, the diameter of the at least one through hole being smaller than the diameter of the first conduit.

18. A water efficient toilet according to claim 17, wherein the openings of the channel are parallel to each other and are disposed at a 45 degree angle with respect to the upper rim of the bowl so as to provide a circular flow of water within the bowl.

19. A water efficient toilet including:

a single valve valve means operatively connected to a water supply through conduit means and a connection means, said no water supply supplying said toilet with water through said conduit means;

a toilet assembly having a bowl with inner walls, said bowl having a lower reservoir connected to a trap way and an upper rim having a channel therein, said channel being provided with a plurality of openings, said lower reservoir of the bowl having at least one through hole, said at least one through hole of the lower reservoir and said channel of the upper rim of the bowl being connected to the valve means by a first and a second conduit, respectively, wherein said toilet is flushed by actuating said valve means between:

an open position of said valve means so as to induce a phased inflow of water in said toilet, said phased inflow of water including an initial and an intermediate inflow of water, said initial inflow of water passing into the first conduit and through said at least one through hole of the lower reservoir to initiate evacuation of the contents of the lower reservoir through the trap way into a drain pipe, and, subsequently, said intermediate inflow of water passes into the second conduit and into the channel of the upper rim, said intermediate inflow of water washing the inner walls of the bowl and completing, in conjunction with the initial inflow of water, the evacuation of the contents of the lower reservoir, and a closed position of said valve means so as to induce a final inflow of water by releasing, via gravity, a predetermined volume of water into the lower reservoir, said predetermined volume of water being contained in the channel of the upper rim, and in the first and the second conduit.

20. A water efficient toilet according to claim 19, wherein the channel of the upper rim, the first and second conduits and the connection means have a combined volume of water that is substantially equivalent to the predetermined volume of water of the lower reservoir.

21. A water efficient toilet according to claim 20, wherein the at least one through hole and the first conduit have each a diameter, the diameter of the at least one through hole being smaller than the diameter of the first conduit.

22. A water efficient toilet according to claim 21, wherein the openings of the channel are parallel to each other and are disposed at a 45 degree angle with respect to the upper rim of the bowl so as to provide a circular flow of water within the bowl.

23. A water efficient toilet including:

a single valve means operatively connected to a water supply through conduit means, said water supply supplying said toilet with water through said conduit means;

a toilet assembly having a bowl with inner walls, said bowl having a lower reservoir connected to a trap way and an upper rim having a channel therein, said channel being provided with a plurality of openings, said lower reservoir of the bowl having at least one through hole, said at least one through hole of the lower reservoir and said channel of the upper rim of the bowl being connected to a connection means by a first and a second conduit, respectively, said first conduit having a first section disposed vertically and a second section disposed horizontally, said second conduit being substantially disposed horizontally, wherein said toilet is flushed by actuating said valve means between:

an open position of said valve means so as to induce a phased inflow of water into said toilet, said phased inflow of water including an initial and an intermediate inflow of water, said initial inflow of water passing into the first conduit and through said at least one through hole of the lower reservoir to initiate the evacuation of the contents of the lower reservoir through the trap way and into a drain pipe, and subsequently, a pressure build-up is initiated within the first conduit when water traveling in the first conduit reaches the at least one through hole, said pressure build-up traveling back in the first conduit until it reaches the connection means, thereby initiating said intermediate inflow of water, said intermediate inflow of water passing into the second conduit and into the channel of the upper rim, said intermediate inflow of water washing the inner walls of the bowl and completing, in conjunction with the initial inflow of water, the evacuation of the contents of the lower reservoir, and a closed position of said valve means so as to induce a final inflow of water by releasing, via gravity, a predetermined volume of water into the lower reservoir, said predetermined volume of water being contained in the channel of the upper rim, the connection means and the first and the second conduits.

24. A water efficient toilet according to claim 23, wherein the channel of the upper rim, the first and second conduits and the connection means have a combined volume of water that is substantially equivalent to the predetermined volume of water of the lower reservoir.

25. A water efficient toilet according to claim 24, wherein the at least one through hole and the first conduit have each a diameter, the diameter of the at least one through hole being smaller than the diameter of the first conduit.

26. A water efficient toilet according to claim 25, wherein the openings of the channel are parallel to each other and are disposed at a 45 degree angle with respect to the upper rim of the bowl so as to provide a circular flow of water within the bowl.

* * * * *